US010228160B2

(12) United States Patent
Wadia et al.

(10) Patent No.: US 10,228,160 B2
(45) Date of Patent: Mar. 12, 2019

(54) FURNACE CABINET WITH INTEGRAL PROTRUSION

(71) Applicant: Trane International Inc., Piscataway, NJ (US)

(72) Inventors: Anosh Porus Wadia, Tyler, TX (US); Andrew Hamilton Hanks, Tyler, TX (US); Robert Ogden, Piscataway, NJ (US); Delbert Steven Christopher, Reklaw, TX (US)

(73) Assignee: Trane International Inc., Piscataway, NJ (US)

( * ) Notice: Subject to any disclaimer, the term of this patent is extended or adjusted under 35 U.S.C. 154(b) by 473 days.

(21) Appl. No.: 14/851,858

(22) Filed: Sep. 11, 2015

(65) Prior Publication Data

US 2016/0091221 A1 Mar. 31, 2016

Related U.S. Application Data

(60) Provisional application No. 62/057,782, filed on Sep. 30, 2014.

(51) Int. Cl.

| | |
|---|---|
| ***F24H 3/08*** | (2006.01) |
| ***F24H 9/00*** | (2006.01) |
| ***F24H 9/02*** | (2006.01) |

(52) U.S. Cl.
CPC ..... *F24H 3/087* (2013.01); *F24H 9/0057* (2013.01); *F24H 9/02* (2013.01); *F24H 2210/00* (2013.01)

(58) Field of Classification Search
CPC ..... F24H 3/006; F24H 3/025; F24H 3/087; F24H 9/0052; F24H 9/0057; F24H 9/02; F24H 2210/00
See application file for complete search history.

(56) References Cited

U.S. PATENT DOCUMENTS

| | | | | |
|---|---|---|---|---|
| 1,383,852 A * | 7/1921 | Post | ..... | F24H 3/006 110/260 |
| 4,671,057 A | 6/1987 | Kronich | | |
| 6,758,208 B2 * | 7/2004 | Gierula | ..... | F24H 3/087 126/110 R |

* cited by examiner

*Primary Examiner* — David J Laux
(74) *Attorney, Agent, or Firm* — Conley Rose, P.C.; J. Robert Brown, Jr.

(57) ABSTRACT

A furnace has a cabinet having at least one wall at least partially defining an interior space of the cabinet, a heat exchanger disposed in the interior space, and a protrusion formed integrally with the at least one wall, the protrusion extending generally inward into the furnace to at least partially obstruct a circulation airflow through the cabinet.

13 Claims, 5 Drawing Sheets

FURNACE CABINET WITH INTEGRAL PROTRUSION

CROSS-REFERENCE TO RELATED APPLICATIONS

The present application claims priority under 35 U.S.C. 119(e) to U.S. Provisional Patent Application No. 62/057,782 filed on Sep. 30, 2014 by Wadia, et al., and entitled "Furnace Cabinet with Integral Protrusion," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems often include a furnace in many commercial and residential applications for heating and otherwise conditioning interior spaces. Because the efficiency of a furnace in an HVAC system often relies on the heat transfer efficiency of a primary and/or secondary heat exchanger in a furnace, some HVAC systems comprise furnaces with add on baffles and/or alternative flowpaths that are configured to redirect airflow into contact with the heat exchangers in order to increase efficiency of the furnace and subsequently the HVAC system.

SUMMARY

In some embodiments of the disclosure, a furnace id disclosed as comprising: a cabinet comprising at least one wall at least partially defining an interior space of the cabinet; a heat exchanger disposed in the interior space; and a protrusion formed integrally with the at least one wall, the protrusion extending generally inward into the furnace to at least partially obstruct a circulation airflow through the cabinet.

In other embodiments of the disclosure, a furnace cabinet id disclosed as comprising: a three wall wrapper comprising a sheet of material bent substantially into a U-shape; wherein at least one of the three walls comprise a first integral protrusion that extends into a space generally bound by the three walls.

In yet other embodiments of the disclosure, a method of increasing heat transfer is disclosed as comprising: providing a cabinet wall with an integral protrusion at least partially upstream in a circulation airflow relative to a heat exchanger; passing an airflow into contact with the integral protrusion; and directing the airflow with the integral protrusion at least partially towards the heat exchanger.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Some furnaces may have airflow paths that are not optimized for contacting air with heat exchangers. Allowing air to pass out of a furnace with only minimal contact with a heat exchanger may reduce an efficiency of the furnace. In some embodiments of this disclosure, a condensing gas-fired furnace is provided that manages fluid flow including hot combustion gasses and condensation.

Figure 1:
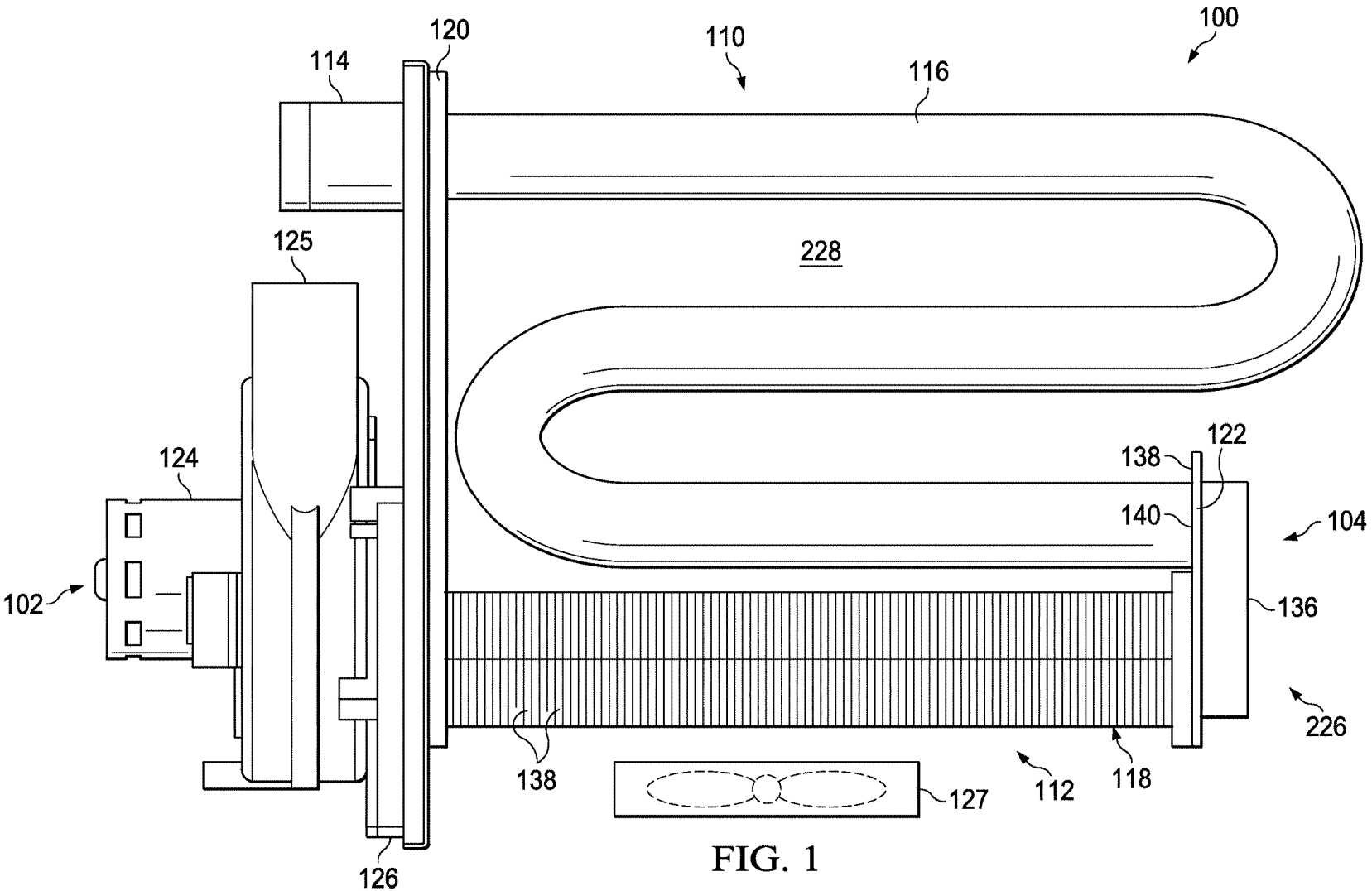
FIG. 1 is an orthogonal right view of a portion of a furnace according to the disclosure.
Figure 2:
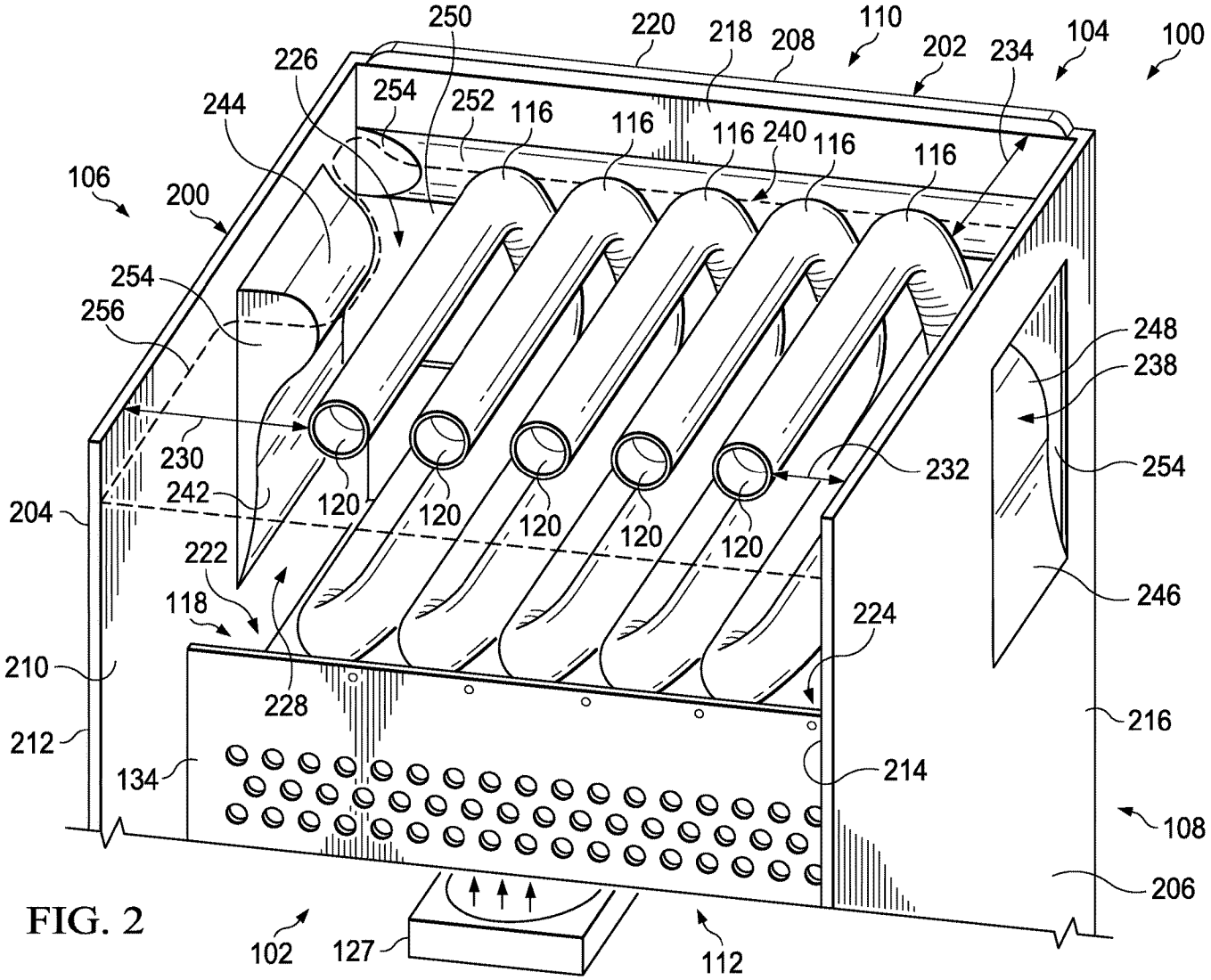
FIG. 2 is an oblique front view of a portion of the furnace of FIG. 1 shown additionally with a portion of a furnace cabinet.
Figure 3:
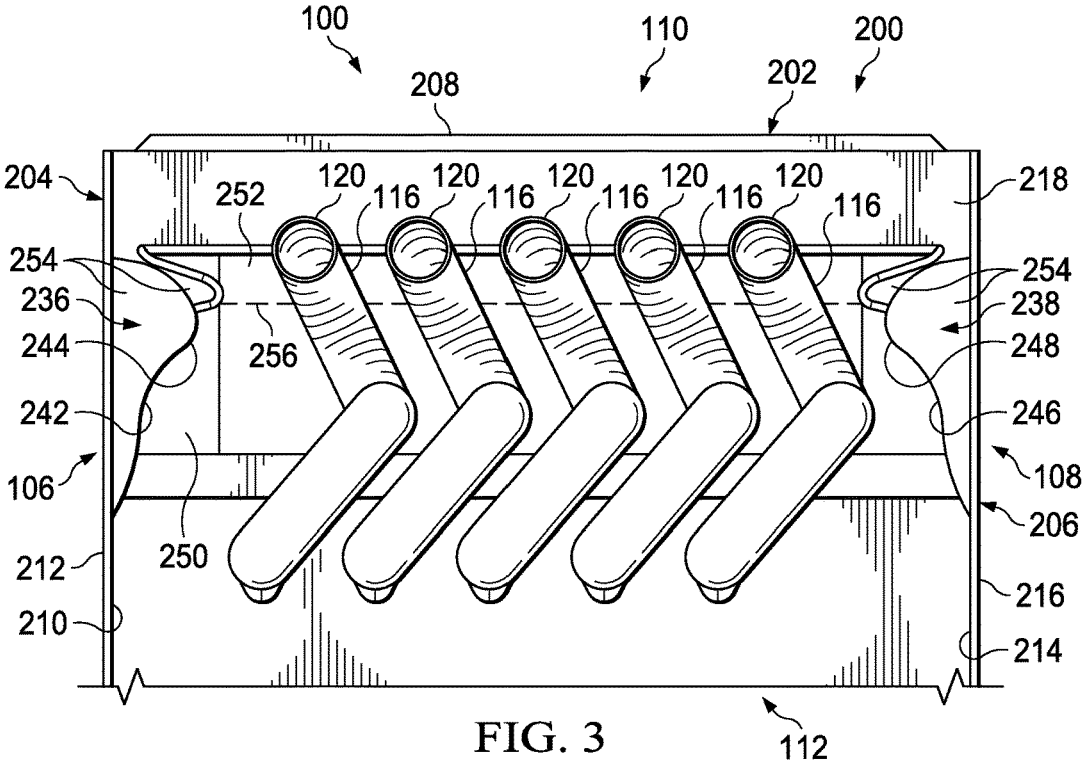
FIG. 3 is an orthogonal front view of a portion of the furnace of FIG. 1.
Figure 4:
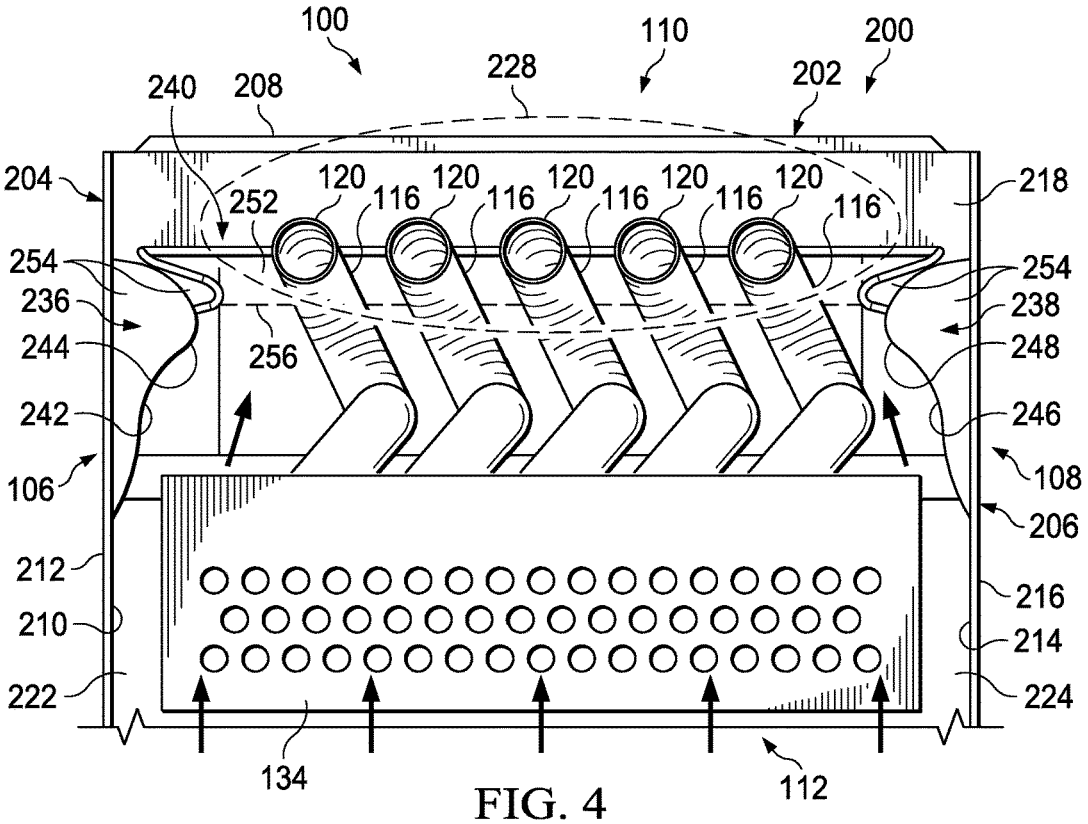
FIG. 4 is an orthogonal front view of another portion of the furnace of FIG. 1.
Figure 5:
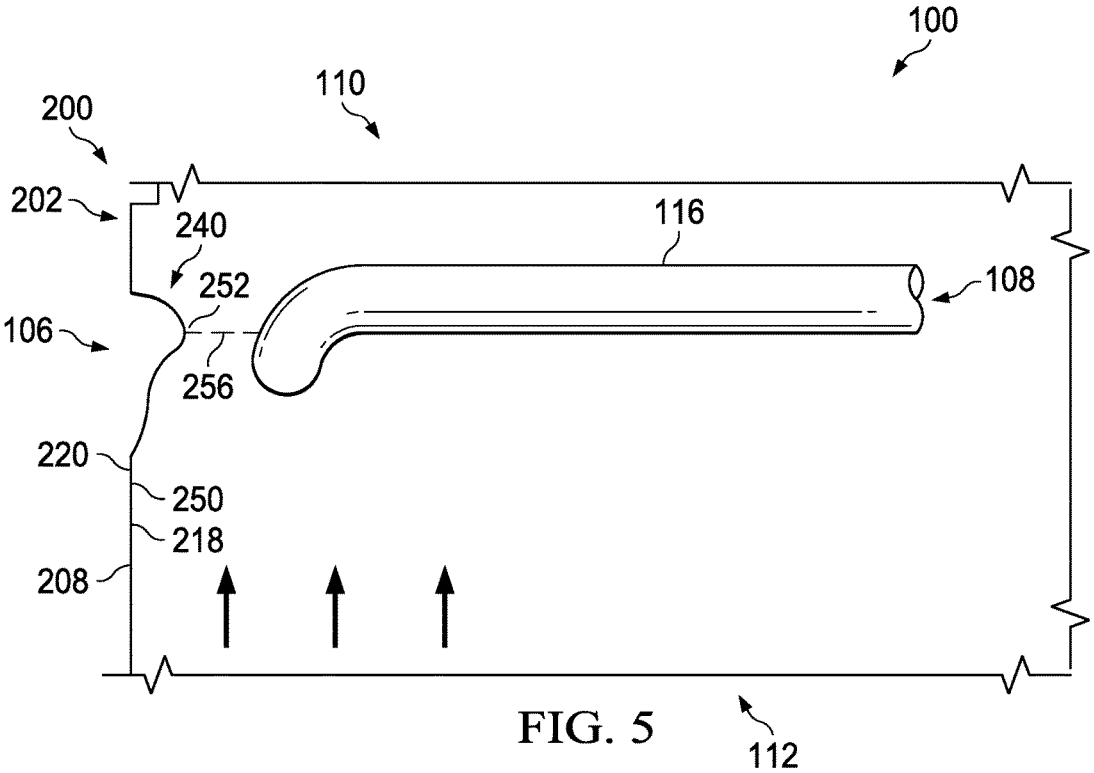
FIG. 5 is schematic orthogonal left view of another portion of the furnace of FIGS. 1.

Referring now to FIGS. 1-5, a condensing gas-fired furnace 100 according to an embodiment of the disclosure is shown. FIG. 1 shows an orthogonal right side view of the combustion components of the furnace 100, and FIG. 2 shows some of the combustion components of the furnace 100 disposed in a portion of a furnace cabinet 200 of the furnace 100. FIGS. 3 and 4 show front views of different portions of the furnace 100. FIG. 5 shows a schematic orthogonal left view of a different portion of the furnace 100. In this embodiment, the furnace 100 is configured as an indoor furnace 100 that provides conditioned, heated air to an interior space. The components of the furnace 100, however, may be equally employed in an outdoor or weatherized furnace to condition an interior space. Moreover, the furnace 100 may be used in residential or commercial applications. The furnace 100 may generally comprise a front side 102, rear side 104, left side 106, right side 108, top side 110, and bottom side 112.

In this embodiment, the furnace 100 may comprise a burner assembly 114, a plurality of primary heat exchangers 116, and a finned, condensing, secondary heat exchanger 118. The primary heat exchangers 116 may extend from the burner assembly 114 to the secondary heat exchanger 118. In this embodiment, each burner assembly 114 may have an associated primary heat exchanger 116 for venting hot flue gases, such that the primary heat exchanger 116 is in the combustion airflow path of its associated burner assembly 114. In general, the total number of burner assemblies 114 and/or heat exchangers 116 may vary depending upon the desired capacity of the furnace 100. In alternative embodiments, the furnace 100 may comprise a non-condensing furnace and the various components of the non-condensing furnace may be different than the components of furnace 100.

Each primary heat exchanger 116 may comprise a bent, S-shaped tubular member that extends through a tortuous path to enhance the surface area available for heat transfer with the surrounding circulation air. Each primary heat exchanger 116 may comprise a first open end 120 defining a flue gas inlet and a second open end 122 defining a flue gas outlet. The second open end 122 of each primary heat exchanger 116 may feed the secondary heat exchanger 118 so that the primary heat exchangers 116 transport hot flue gases to the secondary heat exchanger 118. Although the primary heat exchangers 116 are tubular in some embodiments, the primary heat exchangers 116 may comprise, for example, clamshell, drum, shell and tube-type, and/or any other suitable type of heat exchangers.

In general, combustion air may be introduced into the furnace 100 either in induced draft mode by pulling air through the system or in forced draft mode by pushing air through the system. In this embodiment, induced draft mode may be employed by pulling the hot flue gases from the secondary heat exchanger 118 with a blower or fan 124 by creating a relatively lower pressure at the exhaust of the secondary heat exchanger 118. A control system may control the blower or fan 124 to an appropriate speed to achieve adequate air flow for a desired firing rate through the burner assemblies 114. Increasing the fan speed of the blower or fan 124 may introduce more air to the air/fuel mixture, thereby changing the characteristics of the combustion within the burner assemblies 114.

A circulation blower 127 may blow circulation air across the primary heat exchangers 116 and the secondary heat exchanger 118 to enable the transfer of thermal energy from the primary heat exchangers 116 and the secondary heat exchanger 118 to the air. The heated, exiting airflow may then be distributed to a conditioned area. The furnace 100 is shown in a first orientation in which the circulation blower is nearer the bottom side 112 of the furnace 100 relative to the primary heat exchangers 116 and blows the circulation air across the primary heat exchangers 116 and up toward the top side 110 of the furnace 100.

While moving through the primary heat exchangers 116 and then the secondary heat exchanger 118, the hot flue gases may begin to cool and continue cooling as they move through the secondary heat exchanger 118, a cold header 126, and then the blower or fan 124. Finally, the flue gases may move through an exit pipe 125, then through a flue pipe (not shown), and exit out the flue pipe to the outside environment. As the flue gases cool throughout the secondary heat exchanger 118, the flue gases may cool below the dew point temperature of the water vapor, which may be mixed with corrosive combustion products, producing a corrosive condensate. Accordingly, this system may be referred to as a condensing gas-fired furnace 100. The cold header 126 may provide a drainage path for managing and/or draining the condensate and/or any other liquid.

In some cases, the condensate may form within and/or flow through tubes 128 of the secondary heat exchanger 118. The secondary heat exchanger 118 may further comprise fins 130, an input end plate 132, and an output end plate 134. The tubes 128 may comprise a corrosion resistant metal, such as, but not limited to 29-4C stainless steel, 2205 stainless steel, T140 aluminized steel, and/or any other suitable corrosion resistant material. The furnace 100 may further comprise a hot header cover 136 that joins to a hot side panel 138. The hot side panel 138 may comprise apertures 140 for receiving hot combustion gasses from the primary heat exchangers 116 into a space between the hot header cover 136 and the hot side panel 138.

Referring now to FIG. 2, the cabinet 200 is shown without a front cover attached. In some embodiments, the cabinet 200 comprises a three wall wrapper 202 comprising a left wall 204, a right wall 206, and a back wall 208. The left wall 204 comprises a mostly flat inner surface 210 and a mostly flat outer surface 212. The right wall 206 comprises a mostly flat inner surface 214 and a mostly flat outer surface 216. The back wall 208 comprises a mostly flat inner surface 218 and a mostly flat outer surface 220. Generally, air delivered through the furnace 100 by the circulation blower 127 may undesirably be routed between the secondary heat exchanger 118 and the three wall wrapper 202. Of course, in embodiments where the furnace 100 is a non-condensing furnace, the furnace 100 may comprise no secondary heat exchanger.

Particularly, in some embodiments, a left air passage 222, a right air passage 224, and a rear air passage 226 may allow relatively unrestricted flow of air between the circulation blower 127 and the interior space 228 of the furnace 100 that is generally downstream of the secondary heat exchanger 118 and bound by the inner surfaces 210, 214, 218 so that air may tend to travel generally unimpeded along the inner surfaces 210, 214, 218. When viewed from above, the furnace 100 may be described as having a left separation distance 230 between the upper portion of the most leftward located primary heat exchanger 116 and the flat inner surface 210. When viewed from above, the furnace 100 may be described as having a right separation distance 232 between the upper portion of the most rightward located primary heat exchanger 116 and the flat inner surface 214. When viewed from above, the furnace 100 may be described as having a back separation distance 234 between the upper portion of the most rearward located primary heat exchanger 116 and the flat inner surface 218.

In this embodiment, rather than allowing the separation distances 230, 232,234 to apply along the entire height of the three wall wrapper 202, a left integral protrusion 236, a right integral protrusion 238, and a back integral protrusion 240 may be formed on any or all of the left wall 204, right wall 206, and back wall 208, respectively. In some embodiments, the integral protrusions 236, 238, 240 may be formed by stamping or otherwise plastically deforming the left wall 204, right wall 206, and back wall 208, respectively. The integral protrusions 236, 238, 240 each extend into the interior space 228 beyond the location of the flat inner surfaces 210, 214, 218, respectively.

In this embodiment, the left integral protrusion 236 comprises a ramp 242 and a U-shaped ridge 244. The ramp 242 is configured to gradually guide air closer to the primary heat exchangers 116 as the air travels upward along the ramp 242. In this embodiment, the right integral protrusion 238 comprises a ramp 246 and a U-shaped ridge 248. The ramp 246 is configured to gradually guide air closer to the primary heat exchangers 116 as the air travels upward along the ramp 246. In this embodiment, the back integral protrusion 240 comprises a ramp 250 and a U-shaped ridge 252. The ramp 250 is configured to gradually guide air closer to the primary heat exchangers 116 as the air travels upward along the ramp 250.

The ramps 242, 246, 250 generally smoothly transitions into the ridges 244, 248, 252, respectively. In this embodiment, the ridges 244, 248, 252 are generally located slightly lower and/or upstream relative to the downstream (in circulation airflow) portions of the primary heat exchangers 116. Further, the left integral protrusion 236, the right integral protrusion 238, and the back integral protrusion 240 may comprise other sloped transitions 254 to join them to the flat inner surfaces 210, 214, 218, respectively. In some cases, the alignment of the ridges 244, 248, 252 may collectively restrict or partially choke airflow through the furnace with the obstructions directing more, higher velocity, and/or more turbulent airflow into contact with the downstream (in circulation airflow) portions of the primary heat exchangers 116. The above-described choking or redirection may additionally be described as presenting a reduced cross-sectional flow path area 256 that generally extends in a planar manner through the ridges substantially orthogonally relative to a primary direction of circulation airflow through the furnace 100.

In addition to altering the circulation airflow characteristics of the furnace 100, the integral protrusions 236, 238, 240 may strengthen the three wall wrapper 202 of the cabinet 200. As such, the each of the left wall 204, right wall 206, and back wall 208 may be stiffer and more resistant to flexure. In some cases, the improved strength provided by the integral protrusions 236, 238, 240 may allow the three wall wrapper 202 to meet design strength requirements even when the three wall wrapper 202 is constructed of a thinner sheet of material, such as thinner sheet metal.

Figure 6:
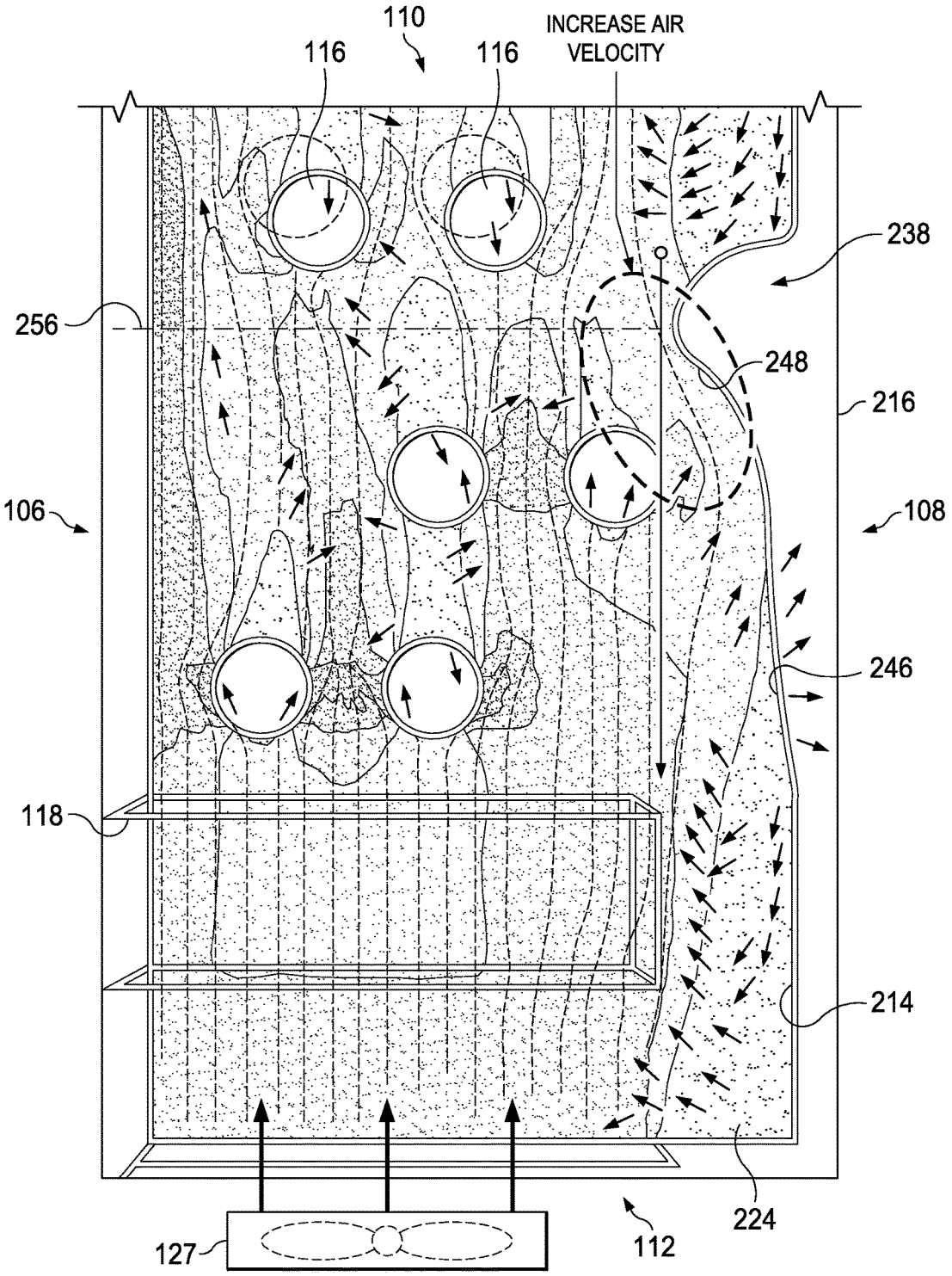
FIG. 6 is an orthogonal front view of a computational fluid dynamics analysis of circulation airflow through the furnace of FIG. 1.

Referring now to FIG. 6, an orthogonal front view of a computational fluid dynamics analysis of circulation airflow through a portion of the furnace of FIG. 1 is shown. In particular, FIG. 6 shows how provision of the integral protrusion 238 causes circulation airflow to encounter a primary heat exchanger 116 at a higher air velocity near the adjacent primary heat exchanger 116 components.

It will be appreciated that the location and/or dimensions of the integral protrusions disclosed herein may be altered and/or optimized for use with alternative arrangements of primary heat exchangers and/or for other desired strength characteristics.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A furnace comprising:

a cabinet comprising at least one wall at least partially defining an interior space of the cabinet;

a heat exchanger disposed in the interior space; and a protrusion formed integrally with the at least one wall, the protrusion extending generally inward into the furnace to at least partially obstruct a circulation airflow through the cabinet;

wherein the protrusion comprises a ridge configured to redirect the circulation airflow into contact with the heat exchanger;

wherein the protrusion comprises a ramp configured to redirect the circulation airflow into contact with the heat exchanger in advance of the circulation airflow containing the ridge.

2. The furnace of claim 1, wherein the heat exchanger comprises a tubular primary heat exchanger.

3. The furnace of claim 1, wherein at least a portion of the protrusion is located upstream in the circulation airflow relative to the heat exchanger.

4. The furnace of claim 1, wherein the protrusion comprises a ramp configured to gradually guide the circulation airflow into contact with the heat exchanger.

5. The furnace of claim 1, wherein the protrusion is formed by stamping a substantially flat sheet of material.

6. A furnace cabinet comprising:

a three wall wrapper comprising a sheet of material bent substantially into a U-shape;

wherein at least one of the three walls comprise a first integral protrusion that extends into a space generally bound by the three walls to at least partially obstruct a circulation airflow through the furnace cabinet; and a heat exchanger disposed in the space;

wherein the first integral protrusion comprises a ridge configured to redirect the circulation airflow into contact with the heat exchanger;

wherein the first integral protrusion comprises a ramp configured to redirect the circulation airflow into contact with the heat exchanger in advance of the circulation airflow contacting the ridge.

7. The furnace cabinet of claim 6, wherein the three wall wrapper comprises two opposing walls and wherein the first integral protrusion is disposed on a first of the two opposing walls and a second integral protrusion that extends into the space generally bound by the three walls is disposed on a second of the two opposing walls.

8. The furnace cabinet of claim 7, wherein the first integral protrusion and the second integral protrusion are located substantially opposite each other along a length of the furnace cabinet.

9. The furnace cabinet of claim 7, wherein the opposing walls are joined by a third wall and wherein the third wall comprises a third integral protrusion that extends into the space generally bound by the three walls.

10. The furnace cabinet of claim 9, wherein the first integral protrusion, the second integral protrusion, and the third integral protrusion are located substantially at a same location along a length of the furnace cabinet.

11. A method of increasing heat transfer, comprising:

providing a cabinet wall with an integral protrusion to at least partially obstruct a circulation airflow through the cabinet;

passing the circulation airflow into contact with the integral protrusion; and directing the circulation airflow with the integral protrusion at least partially towards a heat exchanger;

wherein the integral protrusion comprises a ridge configured to redirect the circulation airflow into contact with the heat exchanger;

wherein the integral protrusion comprises a ramp configured to redirect the circulation airflow into contact with the heat exchanger in advance of the circulation airflow contacting the ridge.

12. The method of claim 11, wherein the integral protrusion comprises a stamped concavity formed in a sheet metal wall.

13. The method of claim 11, wherein the integral protrusion reduces a cross-sectional airflow area available to the circulation airflow.

* * * * *